US009975748B2

(12) United States Patent
Bridgman, Jr.

(10) Patent No.: US 9,975,748 B2
(45) Date of Patent: May 22, 2018

(54) PORTABLE KNOCKDOWN BOAT HOIST

(71) Applicant: Charles James Bridgman, Jr., Kettering, OH (US)

(72) Inventor: Charles James Bridgman, Jr., Kettering, OH (US)

( * ) Notice: Subject to any disclaimer, the term of this patent is extended or adjusted under 35 U.S.C. 154(b) by 0 days. days.

(21) Appl. No.: 15/194,705

(22) Filed: Jun. 28, 2016

(65) Prior Publication Data

US 2017/0050828 A1 Feb. 23, 2017

Related U.S. Application Data

(60) Provisional application No. 62/231,270, filed on Jul. 1, 2015.

(51) Int. Cl.
*B66F 7/10* (2006.01)
*B66F 7/02* (2006.01)

(52) U.S. Cl.
CPC ..... *B66F 7/02* (2013.01)

(58) Field of Classification Search
USPC ..... 254/89 R, 134.7 B, 281
See application file for complete search history.

(56) References Cited

U.S. PATENT DOCUMENTS 2,889,062 A * 6/1959 Stearn ..... B60P 3/1091 254/281
4,231,044 A * 10/1980 Henkel ..... B60S 9/04 280/763.1
5,051,056 A * 9/1991 Gibbons ..... B66C 23/48 248/201
5,281,077 A * 1/1994 Phillips ..... B66F 7/02 187/242
6,584,922 B1 * 7/2003 Fritz ..... B66F 7/02 114/44

* cited by examiner

*Primary Examiner* — Joseph J Hail
*Assistant Examiner* — Shantese McDonald
(74) *Attorney, Agent, or Firm* — Garrett James O'Sullivan; Eric Brandon Lovell; Timothy Marc Shropshire

(57) ABSTRACT

Disclosed is a portable knockdown boat hoist for lifting boat from boat trailer or other resting location. Comprising of two A-frame structures positioned over the bow and stern of the boat. Each A-frame unit consists of two splayed legs on each side of the boat connected by a crossmember running over the top of the boat. At each side of the boat attached to one leg is a winch with a block and pulley connected by cable to the winch. Cranking up on the winch pulls up a lifting strap running underneath the hull of the boat, which in turn lifts the boat. The A-frame structures are comprised of tube sections that insert one end into the next section. A-frame units can be disassembled for transporting to boat location for lifting.

12 Claims, 6 Drawing Sheets

PORTABLE KNOCKDOWN BOAT HOIST

CROSS-REFERENCE TO RELATED APPLICATION(S)

The present application claims priority to 62/231,270, filed 2015 Jul. 24, entire disclosure of which is incorporated by reference herein.

BACKGROUND OF THE INVENTION

Field of Invention

This invention relates to boat lifts.

Description of Related Art

The following is a tabulation of some prior art that presently appears relevant:

| US patents | | | |
|---|---|---|---|
| Pat. No. | Kind Code | Issue Date | Patentee |
| 6,584,922 | B1 | 2003 Jul. 1 | Fritz |
| 5,290,124 | A | 1994 Mar. 1 | Pavlescak |
| 5,281,077 | A | 1994 Jan. 25 | Phillips |
| 2,889,062 | A | 1959 Jun. 2 | Steam |
| 1,298,508 | A | 1919 Mar. 25 | Jerome |
| 1,257,033 | A | 1918 Feb. 19 | Shook |

Boats that are 26 feet long or shorter are usually stored on a trailer at the boat owner's residence or storage facility. When the boat owner needs to work on the hull of the boat, which is at least annually, the boat must be lifted from its trailer. To lift the boat from the trailer, the boat owner must trailer the boat to a facility with a large stationary hoist, such as a marina or boat yard. Not all marinas or boat yards have a large stationary hoist so finding a facility with a large stationary hoist may be difficult for the boat owner. Because large stationary hoists are limited in number and availability, travel to the facility when the large stationary hoist is available may be inconvenient for the boat owner.

Moreover, a boat owner may need to lift a boat that is 26 feet long or shorter when it is resting on a surface other than the boat trailer. For example, the boat may be resting on the ground or it could be resting on boat jacks or a boat cradle while the boat is in storage. If the boat owner needs to lift a boat from the ground or from boat jacks or a boat cradle, a large stationary hoist is useless unless the boat is resting directly beneath the large stationary hoist.

To solve these problems, the boat owner needs is a portable boat hoist that can be brought to the boat and which can safely and securely lift the boat from whatever position the boat is in regardless of whether the boat is resting on a trailer, ground or support structure.

Prior art shows methods of lifting boats from trailers using a non-stationary hoist. However, the non-stationary hoists disclosed in prior art are limited in the circumstances under which the boat can be lifted, or require additional components to make the non-stationary hoist work, such as boat jacks or blocks, or present significant safely risks in the manner of lifting the boat.

Boats resting on the ground or boat trailer may not be resting in a level position. When a boat is resting in a non-level position it needs to be rotated and tilted to a level position when it is lifted. The prior art of Fritz only works if the boat is on a boat trailer and only if the boat trailer is itself is in a level position. Prior art of Phillips and others cannot rotate and tilt the boat while lifting so it cannot safely lift the boat from an unlevel surface.

Several types of boat lifts have been designed that are inherently unsafe. Fritz discloses a design whereby the boat is lifted using the tow hook located on the bow of the boat. The tow hook is meant to pull the boat in a horizontal plane when the boat is in the water or on the trailer with a minimal amount of resistance. The Fritz hoist lifts the boat vertically; however, the tow hook is not designed to lift the boat vertically with the weight of the boat resting on the hook.

Phillips discloses a design that lifts the boat by two attachment plates located on the foredeck and the after deck. Once the boat is lifted by these two points running down the center of the boat, it would be unbalanced and prone to tip if not flip over completely.

Steam discloses a design that lifts a boat using one electronic winch. The use of only one winch raises both the front and back of the boat the same height, not allowing for independent raising and lowering of the ends of the boat, which in turn does not allow any leveling of the boat during the lifting process.

All the prior art referenced herein suffer from a number of disadvantages:

(a) None of the previous art is designed to allow the hoist to be disassembled in small enough sections that would easily fit in the back of a SUV or pickup truck, nor are the prior art cable of fitting on a standard 4 foot shipping skid. This limits their ability to easily be transported to the boat location for use.

(b) Generally the prior art designs require the use of an electric winch to raise the boat. This requires the location to have a standard 110 v ac electric outlet available and conveniently located for access to the boat. Many boat storage facilities or boat yards do not have electric outlets where boats are stored. This would require the use of a portable power generator to run the electric winches.

(c) All the previous art stated herein lift the boat at one or two points on the boat. This does not allow for the boat to be tilted and rotated during the lift to level the boat when it needs to be lifted from unlevel ground or if it is resting in a tiled position.

SUMMARY OF THE INVENTION

In an embodiment, a portable boat hoist for the lifting of a boat comprised of two identical A-frame structures running parallel to the length of the boat, one A-frame structure positioned over the bow of the boat and the other A-frame structure positioned over the stern of the boat. Each of these A-frame structures has a winch and pulley system attached at each side of both A-frame structures. A lifting strap is attached to each pulley system with said lifting strap running underneath the hull of the boat at both the bow and stern. Cranking in the winch on each corner of each A-frame structure gathers in the pulley system which in turn lifts the boat strap which then raises the boat. The portable boat hoist is comprised of segments that are easily disassembled into smaller sections which makes the transport of the portable boat hoist to the location of the boat easy and convenient for the boat owner.

Advantages

In an embodiment, Applicant's portable boat hoist has several advantages of one or more aspects as follows:

(a) Hoist can be knocked down into smaller segments for easy transportation to and from boat.

(b) Hoist uses no electrical motors and can be operated without electrical power source.

(c) Hoist can rotate and tilt boat during lift for leveling of final position.

(d) Hoist can lift boats sitting on trailers, boat cradles, boat jacks or boats resting on the ground.

(e) Hoist can be reconfigured to smaller size to lift items such as boat motors.

In an embodiment, Other advantages of one or more aspects will be apparent from the consideration of the drawings and ensuing description.

CONCLUSION, RAMIFICATIONS, AND SCOPE

Accordingly, the reviewer will see that the portable boat hoist allows boats to be: lifted for maintenance and other reasons wherever they are located, without the need to transport them to a stationary lifting facility; lifted from a variety of resting positions whether in a level holding structure such as a boat cradle or laying over on its side on the ground; rotated and tilted so the boat is level during and after the lift. In addition, the portable boat hoist can be disassembled for easy transportation and requires no electric power source for operation.

Although the description above contains many specificities, these should not be constructed as limiting the scope of the embodiment but merely illustrate several embodiments. For example the hoist can be reconfigured to a smaller size utilizing a single A-frame structure by itself, allowing for lifting of smaller items such as motors.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
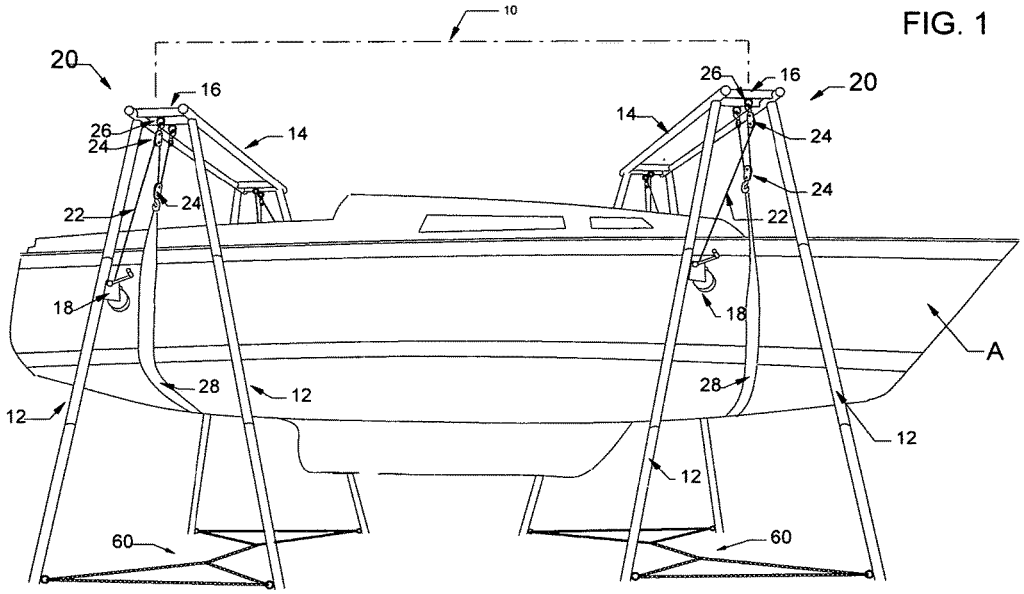
FIG. 1 is a side elevation view of embodiment 1 showing boat in a lifted position, according to an embodiment of the present invention.

Preferred embodiments of the present invention and their advantages may be understood by referring to FIGS. 1-6) wherein like reference numerals refer to like elements.

REFERENCE NUMERALS

10 hoist apparatus
12 A-frame structure leg
14 crossmember section
16 shoulder section
18 winch
20 elongated A-frame structure
22 winch cable
24 snatch block pulley
26 eyehook
28 lifting strap
30 cable hook
32 top leg segment
34 leg strut
36 scaffolding locking pin
38 middle leg segments
40 male insert
42 bottom leg segments
44 male crossmember segment
46 female crossmember segment
48 tension chain triangle
50 tension chain middle segment
60 tension chain assembly

DETAILED DESCRIPTION

First Embodiment

Figure 2:
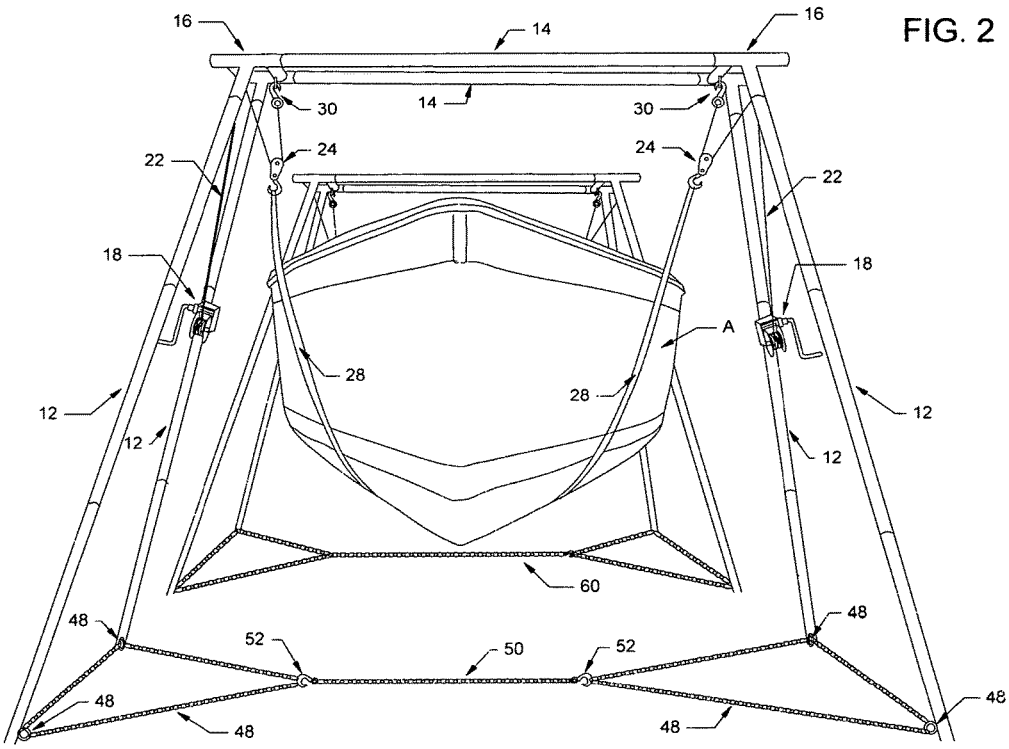
FIG. 2 is a front elevation view of embodiment 1 showing boat in a lifted position, according to an embodiment of the present invention.

Referring now to the drawings, the first embodiment is shown in FIGS. 1 and 2, generally at 10 comprising two identical vertical A-frame structures transversely disposed indicated by 20. In FIG. 1, the A-frame structures 20 are deployed at the bow and stern of boat A.

Each A-frame structure includes a pair of splayed legs 12 on each side. Two parallel crossmembers 14 travel across and over the boat A attaching to a shoulder section 16 that attach to the top of the leg sections 12.

Figure 3:
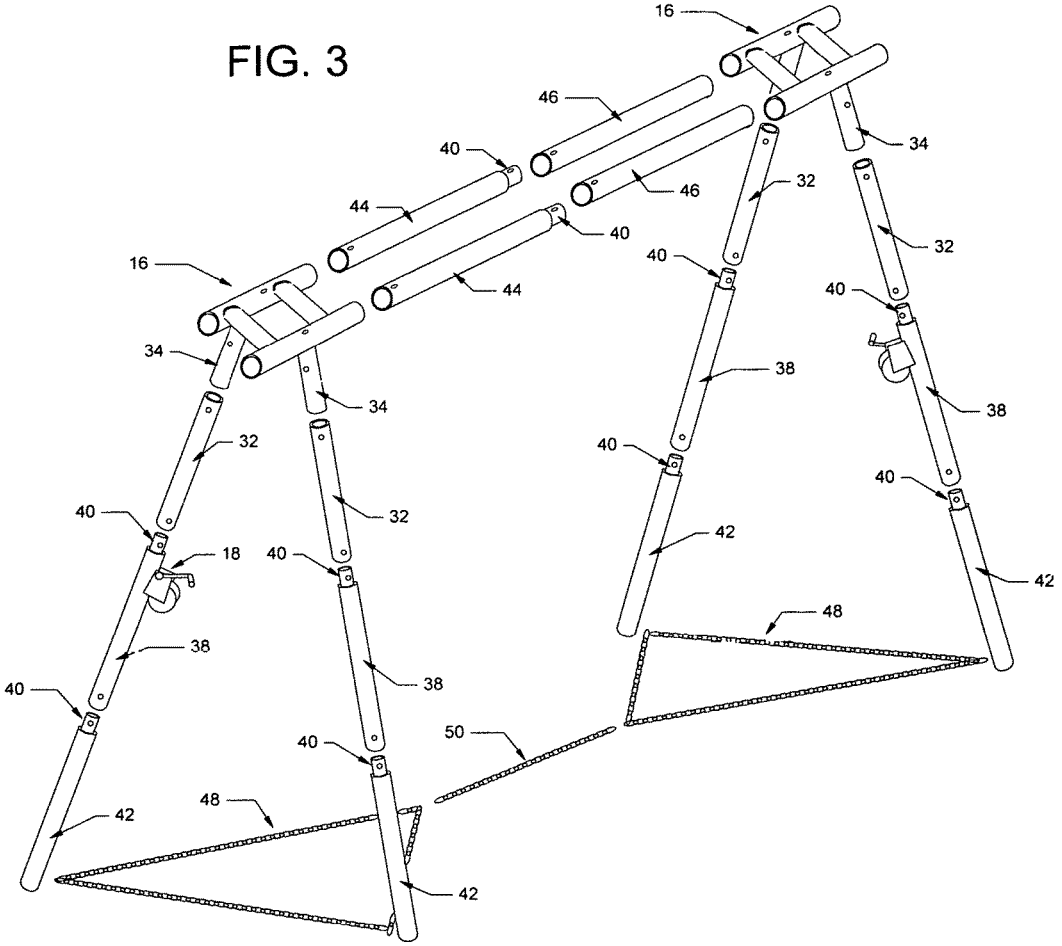
FIG. 3 is an exploded view of embodiment 1, according to an embodiment of the present invention.
Figure 4:
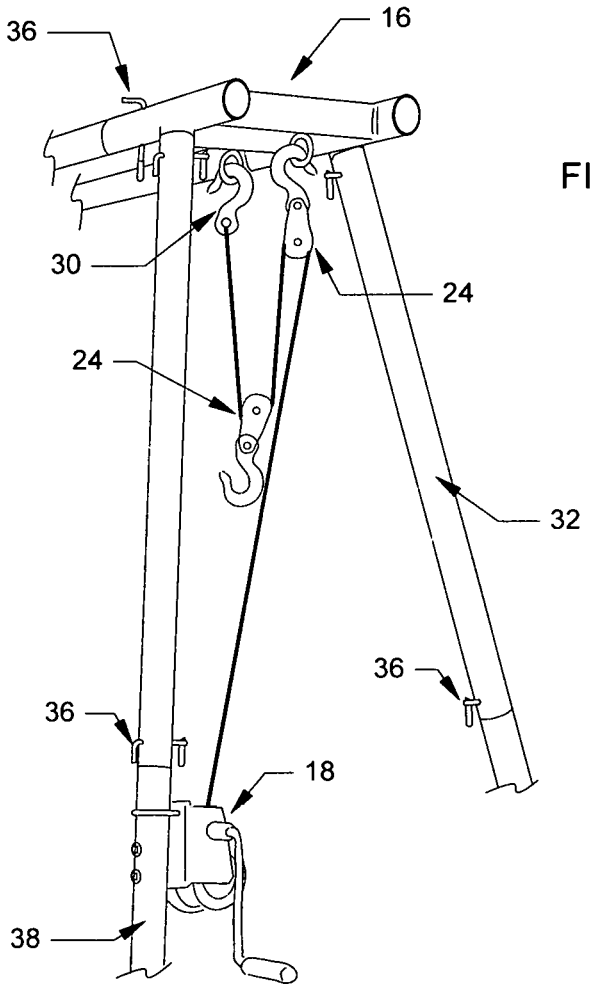
FIG. 4 is a perspective view of the winch and cable with pulley system attached to leg of A-frame structure, according to an embodiment of the present invention.
Figure 5:
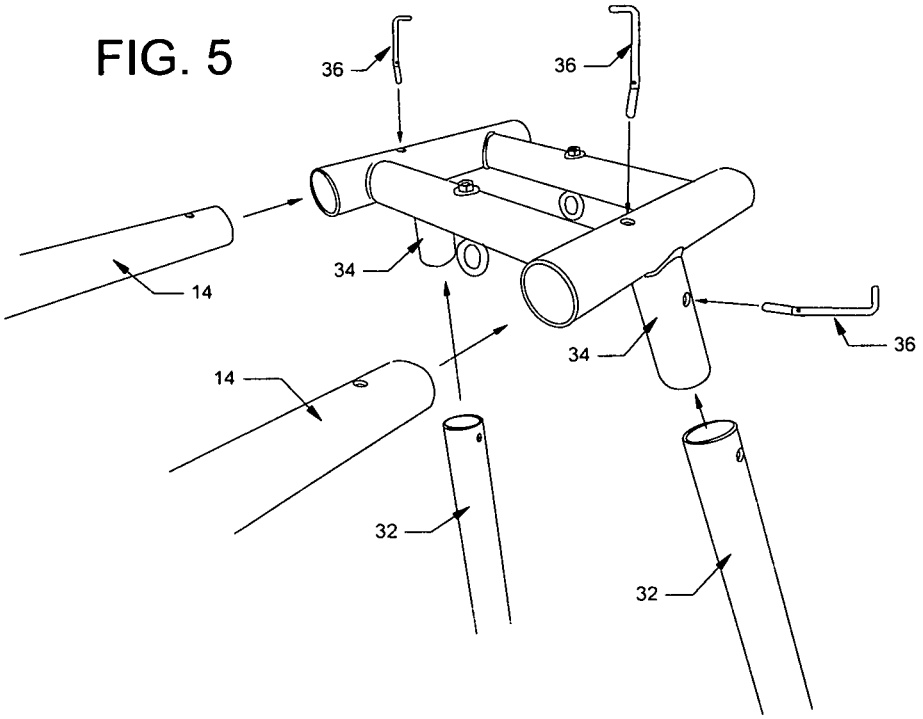
FIG. 5 is a perspective exploded view of the A-frame shoulder section with attached legs and crossmembers, according to an embodiment of the present invention.

FIG. 3 shows the assembly of a single A-frame structure. Each leg section 12 is comprised of three segments. The top leg segment 32 inserts over a strut 34 welded to the shoulder section 16 at a 12½° degree angle outward away from the boat and a 12½° angle forward for the front leg and 12½° angle rearward for the back leg. FIG. 5 displays the top leg section 32 which has a slip fit tolerance over the strut 34 that is held in place with a scaffolding lock pin 36 passing through an aligned hole in both the top leg section 32 and the strut 34. FIG. 3 shows the middle leg segment 38 with the winch 18 attached to the top portion. The middle leg segment 38 has a coupling insert 40 welded onto it. The coupling insert 40 fits into the bottom of top leg segment 32 and is held in place with a scaffolding lock pin 36 which is inserted to aligned holes on the bottom of 32 and 40 as shown in FIG. 3. Bottom leg segment 42 also has a coupling insert 40 welded onto its top. In a similar fashion, coupling insert 40 shown on the top of segment 42 is inserted into the bottom of 38 and held in place with a scaffolding lock pin 36.

FIG. 3 shows the parallel crossmembers on top of one of the A-frame structures comprised of two segments. Male crossmember segment 44 has a coupling insert 40 welded onto the end. This coupling insert 40 attaches to the female crossmember segment 46 and is held in place with a scaffolding lock pin 36. FIG. 5 shows the ends of the crossmember unit 14 inserted into the shoulder sections 16 as shown which is held in place with a scaffolding lock pin 36.

FIG. 1 shows a winch 18 attached to the middle leg segment 36 per each side of each A-frame structure 10. The winch 18 has its cable 22 running through a pulley system. The pulley system is comprised of two snatch blocks 24. The first snatch block 24 attached to the cable 22 is attached to an eyebolt 26 on the shoulder section 16. The second snatch block 24 is attached to a lifting strap 28 that runs under the hull of the boat A. Winch cable end is attached to a hook 30 that is attached to the shoulder section 16.

FIG. 2 shows an eyebolt 44 attached at the bottom of each leg segment 12. To this a tension chain assembly 60 is attached to eyebolt 44. The tension chain assembly 60 is comprised of two triangular chain segments 48. Two ends of the triangle 48 are attached to the eyebolts 44. The third conner of the triangle 48 attaches to a chain middle segment 50 using two chain hooks 52 attached to each end of the middle chain segment 50.

Operation

By these above structural arrangements, the A-frame structures 16 are positioned over the bow and stern of the boat A. The lifting straps 28 are attached to the snatch block 24 and passed under the hull of the boat A. The winches on each side of the A-frame structure reel in the cable 22 raising each end of the lifting strap 28 at a two to one ratio. The lifting strap 28 lifts the hull of the boat. The four winches 18 are operated independently of each other, allowing the boat to be raised in a level manner even if the ground underneath the boat is not level.

The weight of the boat is held up by the leg sections 12. The leg sections 12 are kept from falling inwards at the top by attaching to shoulder sections 16 which is positioned by crossmember section 14. The leg sections 12 are kept from splaying outward by tension chain assembly 60 attached to the bottom of the legs 12. Since the legs 12 are wider at their base, this allows for clearance of a boat trailer to be pulled out from underneath the boat and positioned back under the boat as required.

Additional Embodiment

FIG. 6

Figure 6:
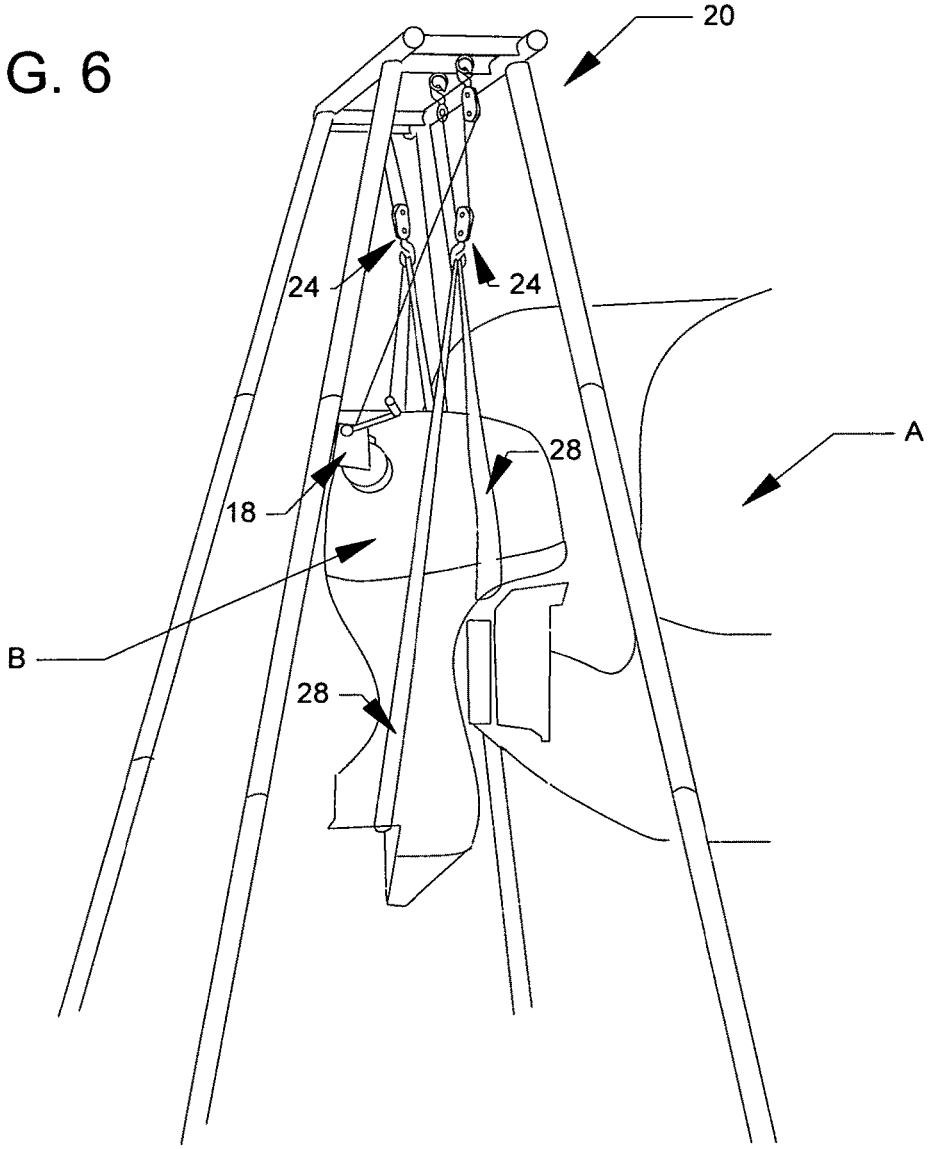
FIG. 6 is a side perspective view of a second embodiment of the portable boat hoist made, according to an embodiment of the present invention.

An additional embodiment is shown in FIG. 6 where a single A-frame structure 20 is positioned standing over a Marine outboard motor B. The width of the A-frame structure 20 is reduced to half by using only the female crossmember section 46 and not inserting male crossmember section 44. Lifting strap 28 is secured around outboard motor B with ends of lifting strap 28 both connected to snatch blocks 24 on each side of the single A-frame structure. In this way, when winch 18 is cranked in, the outboard motor is lifted off the boat. The removal of the outboard motor from the boat is useful for replacing or doing maintenance on the outboard motor.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed.

I claim:

1. A portable boat hoist device comprising:

a. a hoist apparatus comprising:

i. a first A-frame structure having a first set of splayed legs separated from a second set of splayed legs, wherein a first segmented cross member separates the first set of splayed legs from the second set of splayed legs; and ii. a second A-frame structure having a first set of splayed legs separated from a second set of splayed legs, wherein a second segmented cross member separates the first set of splayed legs from the second set of splayed legs;

b. one or more winches in mechanical communication with one or more pulleys, wherein a bottom of the first set of splayed legs of the first A-frame structure are separated from a bottom of the second set of splayed legs of the first A-frame structure by a first tension chain assembly.

2. The device of claim 1, wherein a bottom of the first set of splayed legs of the second A-frame structure are separated from a bottom of the second set of splayed legs of the second A-frame structure by a second tension chain assembly.

3. The device of claim 2, wherein the first A-frame structure is not connected to the second A-frame structure.

4. The device of claim 2, wherein the first set of splayed legs of the first A-frame structure are comprised of a plurality of segments, wherein the second set of splayed legs of the first A-frame structure are comprised of a plurality of segments, wherein the first set of splayed legs of the second A-frame structure are comprised of a plurality of segments, and wherein the second set of splayed legs of the second A-frame structure are comprised of a plurality of segments.

5. The device of claim 2, wherein the first tension chain assembly has a adjustable midsection configured to adjust a distance between the bottom of the first set of splayed legs of the first A-frame and the bottom of the second set of splayed legs of the first A-frame structure, and wherein the second tension chain assembly has a adjustable midsection configured to adjust a distance between the bottom of the first set of splayed legs of the second A-frame and the bottom of the second set of splayed legs of the second A-frame structure.

6. The device of claim 5, wherein the device is collapsible.

7. The device of claim 2, wherein a height and width of the first A-frame structure are adjustable, and wherein a height an width of the second A-frame structure are adjustable.

8. The device of claim 1, wherein the first A-frame structure is not connected to the second A-frame structure.

9. The device of claim 1, wherein the first segmented cross member is defined by at least two parallel segmented members each comprising a plurality of segments, and wherein the second segmented cross member is defined by at least two parallel segmented members each comprising a plurality of segments.

10. The device of claim 1, wherein the device comprises at least a first winch and a second winch, wherein the first winch is in attached to the first A-frame structure, and wherein the second winch is attached to the second A-frame structure.

11. The device of claim 1, wherein each segment of the first segmented cross member are attached to adjacent segments with one or more releasable pins, and wherein each segment of the second segmented cross member are attached to adjacent segments with one or more releasable pins.

12. The device of claim 1, wherein the first set of splayed legs of the first A-frame structure extend downward from the first segmented cross member at an obtuse angle relative to the first segmented cross member, and wherein the second set of splayed legs of the first A-frame structure extend downward from the first segmented member at an opposite obtuse angle of the first set of splayed legs of the first A-frame structure.

* * * * *